US009943165B2

(12) United States Patent
Gosling et al.

(10) Patent No.: US 9,943,165 B2
(45) Date of Patent: Apr. 17, 2018

(54) EMBEDDED FURNITURE HAVING RETRACTIBLE LEGS WITH LIGHTING

(71) Applicant: DIRTT Environmental Solutions, Ltd., Calgary (CA)

(72) Inventors: Geoff W. Gosling, Calgary (CA); Colin V. Blehm, Calgary (CA)

(73) Assignee: DIRTT Environmental Solutions, LTD., Calgary (CA)

( * ) Notice: Subject to any disclaimer, the term of this patent is extended or adjusted under 35 U.S.C. 154(b) by 0 days.

(21) Appl. No.: 15/177,095

(22) Filed: Jun. 8, 2016

(65) Prior Publication Data

US 2017/0224100 A1 Aug. 10, 2017

Related U.S. Application Data

(60) Provisional application No. 62/293,568, filed on Feb. 10, 2016, provisional application No. 62/293,573, filed on Feb. 10, 2016.

(51) Int. Cl.
*A47B 5/00* (2006.01)
*A47B 5/04* (2006.01)
(Continued)

(52) U.S. Cl.
CPC ..... *A47B 5/04* (2013.01); *A47B 5/006* (2013.01); *A47B 46/00* (2013.01); *A47C 4/04* (2013.01);
(Continued)

(58) Field of Classification Search
CPC ..... A47B 13/12; F21V 33/00; F21V 33/0012; F21V 33/0048
(Continued)

(56) References Cited

U.S. PATENT DOCUMENTS 2,042,290 A 5/1936 Barrett
2,658,810 A 11/1953 Ellis
(Continued)

FOREIGN PATENT DOCUMENTS

CA 55086 10/1985
CA 1294107 11/1987
(Continued)

OTHER PUBLICATIONS

Restriction Requirement for U.S. Appl. No. 15/77,084 dated Aug. 18, 2017.
(Continued)

*Primary Examiner* — Matthew W Ing
(74) *Attorney, Agent, or Firm* — Workman Nydegger

(57) ABSTRACT

Embedded furniture systems include a wall having a recessed pocket, a furniture element hingedly connected to the wall and selectively moveable between a storage position in which the furniture element is vertically disposed in the pocket and a utility position in which the furniture element horizontally extends from the pocket, and a support structure hingedly connected to the furniture element and selectively positionable between an extended position in which the support structure protrudes substantially perpendicular to the furniture element and a retracted position in which the support structure extends substantially parallel to the furniture element. An illuminating mechanism illuminates a lighting element disposed in the support structure when the support structure is in the retracted position by bringing a contact element connected to the surface of the furniture element into communication with a circuit element connected to the surface of the support structure to complete an electrical circuit.

25 Claims, 12 Drawing Sheets

(51) Int. Cl.

| | |
|---|---|
| ***A47C 17/38*** | (2006.01) |
| ***A47C 17/86*** | (2006.01) |
| ***A47C 4/04*** | (2006.01) |
| ***F21V 33/00*** | (2006.01) |
| ***F21V 23/02*** | (2006.01) |
| ***F21V 23/04*** | (2006.01) |
| ***A47B 46/00*** | (2006.01) |
| ***E04F 19/08*** | (2006.01) |
| *F21W 131/301* | (2006.01) |

(52) U.S. Cl.
CPC ..... *A47C 17/38* (2013.01); *A47C 17/86* (2013.01); *E04F 19/08* (2013.01); *F21V 23/02* (2013.01); *F21V 23/04* (2013.01); *F21V 33/0012* (2013.01); *F21W 2131/301* (2013.01)

(58) Field of Classification Search
USPC ..... 108/23, 48, 79
See application file for complete search history.

(56) References Cited

U.S. PATENT DOCUMENTS 2,676,481 A 4/1954 Hoffman
3,037,593 A 6/1962 Webster
3,088,127 A * 5/1963 Eames ..... A47C 1/12 108/38
3,180,457 A 4/1965 Bohnsack
3,521,937 A 7/1970 Buhrmaster
3,602,226 A 9/1971 Ericson
3,621,635 A 11/1971 Lange
3,675,382 A 7/1972 Lickliter
3,696,569 A 10/1972 Didry
3,885,361 A 5/1975 De Schutter
4,027,878 A 6/1977 Dadbeh
4,103,373 A 8/1978 Luedtke
4,128,983 A 12/1978 Matsubara
4,277,920 A 7/1981 Dixon
4,438,614 A 3/1984 Raith
4,449,337 A 5/1984 Gzym
4,493,172 A 1/1985 Jones
4,535,577 A 8/1985 Tenser
4,631,881 A 12/1986 Charman
4,688,491 A 8/1987 Herrera
4,752,101 A 6/1988 Yurchenco
4,757,657 A 7/1988 Mitchell
D302,497 S 8/1989 Zapf
D309,381 S 7/1990 Buhk
D309,382 S 7/1990 Randall
D309,384 S 7/1990 Buhk
D309,385 S 7/1990 Buhk
D309,386 S 7/1990 Buhk
4,991,365 A 2/1991 Jackson
5,038,539 A 8/1991 Kelley
5,056,285 A 10/1991 Frascaroli
D321,801 S 11/1991 Friedman
5,064,247 A 11/1991 Clark
D323,251 S 1/1992 Zapf
5,086,597 A 2/1992 Kelley
D325,309 S 4/1992 Worrell
5,117,599 A 6/1992 Voss
D327,794 S 7/1992 Zapf
D328,680 S 8/1992 Zapf
5,144,777 A 9/1992 Fishel
D330,295 S 10/1992 Zapf
5,155,955 A 10/1992 Ball
D330,641 S 11/1992 Zapf
D330,643 S 11/1992 Zapf
5,159,793 A 11/1992 Deugo
D331,335 S 12/1992 Zapf
D331,513 S 12/1992 Zapf
5,171,060 A * 12/1992 Kaye ..... A47C 9/007 108/150
5,172,530 A 12/1992 Fishel
5,184,441 A 2/1993 Balfanz
5,204,149 A 4/1993 Phenicie
5,207,037 A 5/1993 Giles
5,218,799 A 6/1993 Appino
D337,003 S 7/1993 Rowland
5,227,005 A 7/1993 Zodrow et al.
5,321,579 A 6/1994 Brown
D348,786 S 7/1994 Tolleson
5,351,452 A 10/1994 Gates
5,352,033 A 10/1994 Gresham
5,394,668 A 3/1995 Lim
5,488,808 A 2/1996 Cahill
D371,683 S 7/1996 Tolleson
5,544,593 A 8/1996 Canfield
5,592,794 A 1/1997 Tundaun
5,600,926 A 2/1997 Ehrlich
5,601,348 A 2/1997 Minkovski
5,642,593 A 7/1997 Shieh
5,669,314 A * 9/1997 Grant ..... A47B 5/00 108/20
5,740,644 A 4/1998 Menchetti
5,740,650 A 4/1998 Seiber
5,746,035 A 5/1998 Seiber
5,792,541 A 8/1998 Herrera
D397,880 S 9/1998 Saul
D398,464 S 9/1998 Cronk
5,802,789 A 9/1998 Goodman
5,813,178 A 9/1998 Edwards
5,822,935 A 10/1998 Mitchell
5,826,385 A 10/1998 Dykstra
5,836,121 A 11/1998 Hofman
5,839,240 A 11/1998 Eisholz
5,852,904 A 12/1998 Yu
5,870,867 A 2/1999 Mitchell
5,875,596 A 3/1999 Muller
5,881,979 A 3/1999 Rozier
5,913,787 A 6/1999 Edwards
5,950,386 A 9/1999 Shipman
5,978,988 A * 11/1999 Burchett ..... A47C 17/40 5/133
6,012,258 A 1/2000 Brown
6,047,508 A 4/2000 Goodman
6,058,667 A 5/2000 MacDonald
6,094,872 A 8/2000 Ward
6,112,472 A 9/2000 Van Dyk
6,122,871 A 9/2000 Russell
6,128,877 A 10/2000 Goodman
6,134,845 A 10/2000 Shipman
6,141,926 A 11/2000 Rossiter
6,158,179 A 12/2000 Ackerly
6,161,347 A 12/2000 Yu
6,189,270 B1 2/2001 Jeffers
6,223,485 B1 5/2001 Beck
6,250,020 B1 6/2001 Shipman
6,250,032 B1 6/2001 Davis
6,260,321 B1 7/2001 Rudduck
6,282,854 B1 9/2001 Vos
6,295,764 B1 10/2001 Berrdige
6,301,846 B1 10/2001 Waalkes
6,311,441 B1 11/2001 Beavers
6,330,773 B1 12/2001 MacDonald
6,341,457 B1 1/2002 Aerts
6,363,663 B1 4/2002 Kane
6,393,782 B1 5/2002 Berrdige
6,393,783 B2 5/2002 Emaus
6,397,533 B1 6/2002 Hornberger
6,415,567 B1 7/2002 Mead
6,446,396 B1 9/2002 Marangoni
6,481,168 B1 11/2002 Hodges
6,484,465 B2 11/2002 Higgins
6,497,075 B1 12/2002 Schreiner
6,530,181 B1 3/2003 Seiber
6,557,310 B2 5/2003 Marshall
6,571,855 B1 6/2003 Goldsmith
6,581,344 B1 6/2003 Niewiadomski
6,591,563 B2 7/2003 King
6,612,077 B2 9/2003 Parshad
6,619,008 B1 9/2003 Shivak
6,658,805 B1 12/2003 Yu
6,668,514 B2 12/2003 Skov

(56) References Cited

U.S. PATENT DOCUMENTS

| | | | |
|---|---|---|---|
| D485,096 | S | 1/2004 | Overthun |
| 6,684,929 | B2 | 2/2004 | MacDonald |
| 6,688,056 | B2 | 2/2004 | Von Hoyningen Huene |
| 6,701,677 | B2 | 3/2004 | Gresham |
| 6,711,871 | B2 | 3/2004 | Beirise |
| 6,729,085 | B2 | 5/2004 | Newhouse |
| 6,748,710 | B2 | 6/2004 | Gresham |
| 6,775,953 | B2 | 8/2004 | Burken |
| 6,799,404 | B2 | 10/2004 | Spransy |
| 6,807,776 | B2 | 10/2004 | Girdwood |
| 6,820,388 | B2 | 11/2004 | Newhouse |
| 6,851,226 | B2 | 2/2005 | MacGregor |
| 6,865,853 | B2 | 3/2005 | Burken |
| 6,883,277 | B2 | 4/2005 | Wiechecki |
| 6,889,477 | B1 | 5/2005 | Kottman |
| 6,920,727 | B2 | 7/2005 | Yu |
| 6,928,785 | B2 | 8/2005 | Shipman |
| 6,941,716 | B2 | 9/2005 | Kottman |
| 6,944,993 | B1 | 9/2005 | Jilk |
| 6,951,085 | B2 | 10/2005 | Hodges |
| 6,964,138 | B2 | 11/2005 | Carroll |
| 6,981,454 | B2 | 1/2006 | Burdick |
| 6,990,909 | B2 | 1/2006 | Gosling |
| 6,993,875 | B2 | 2/2006 | Rudduck |
| 7,051,482 | B2 | 5/2006 | MacDonald |
| 7,150,127 | B2 | 12/2006 | Underwood |
| 7,210,270 | B1 | 5/2007 | King |
| 7,310,918 | B1 | 12/2007 | Reuter |
| 7,434,790 | B1 | 10/2008 | Hansen |
| 7,451,577 | B2 | 11/2008 | Little |
| 7,461,484 | B2 | 12/2008 | Battey |
| 7,540,115 | B2 | 6/2009 | Metcalf |
| 7,562,504 | B2 | 7/2009 | Herbst |
| 7,603,821 | B2 | 10/2009 | Eberlein |
| 7,644,552 | B2 | 1/2010 | Kuipers |
| 7,661,237 | B2 | 2/2010 | Jakob-Bamberg |
| 7,707,790 | B2 | 5/2010 | Williams |
| 7,818,932 | B2 | 10/2010 | Eberlein |
| 7,827,745 | B2 | 11/2010 | Franceschet |
| 7,832,154 | B2 | 11/2010 | Gosling |
| 7,841,142 | B2 | 11/2010 | Towersey |
| 7,856,777 | B2 | 12/2010 | Lamfers |
| 7,861,474 | B2 | 1/2011 | Houle |
| 7,891,148 | B2 | 2/2011 | Underwood |
| 7,908,805 | B2 | 3/2011 | Metcalf |
| 7,913,459 | B2 | 3/2011 | Ball |
| 7,918,064 | B2 | 4/2011 | Singleton |
| 7,922,224 | B2 | 4/2011 | Arias |
| 7,984,598 | B2 | 7/2011 | Gosling |
| 8,015,766 | B2 | 9/2011 | Gosling |
| 8,015,767 | B2 | 9/2011 | Glick |
| 8,024,901 | B2 | 9/2011 | Gosling |
| 8,033,059 | B2 | 10/2011 | Contois |
| 8,033,068 | B2 | 10/2011 | Luttmann |
| 8,046,957 | B2 | 11/2011 | Towersey |
| 8,151,527 | B2 | 4/2012 | Gosling |
| 8,151,533 | B2 | 4/2012 | Krieger |
| 8,176,707 | B2 | 5/2012 | Gosling |
| 8,215,061 | B2 | 7/2012 | Gosling |
| 8,272,180 | B2 | 9/2012 | Glick |
| 8,307,591 | B2 | 11/2012 | Steinle |
| 8,322,102 | B2 | 12/2012 | Krieger |
| 8,393,122 | B2 | 3/2013 | Henriott |
| 8,474,193 | B2 | 7/2013 | Sutton |
| 8,479,026 | B2 | 7/2013 | Lakshmanan |
| 8,534,021 | B2 | 9/2013 | Liu |
| 8,601,749 | B2 | 12/2013 | Von Hoyningen Huene |
| 8,613,168 | B2 | 12/2013 | Von Hoyningen Huene |
| 8,615,936 | B2 | 12/2013 | Von Hoyningen Huene |
| 8,656,648 | B2 | 2/2014 | Liegeois |
| 8,683,745 | B2 | 4/2014 | Artwohl |
| D710,025 | S | 7/2014 | Johnson |
| 8,910,435 | B2 | 12/2014 | Feldpausch |
| D725,638 | S | 3/2015 | Hofman |
| 8,966,839 | B2 | 3/2015 | Rebman |
| 9,003,731 | B2 | 4/2015 | Gosling |
| D731,833 | S | 6/2015 | Fifield |
| 9,084,489 | B2 | 7/2015 | Gosling |
| 9,206,600 | B2 | 12/2015 | Von Hoyningen Huene |
| 9,284,729 | B2 | 3/2016 | Von Hoyningen Huene |
| 2001/0039774 | A1 | 11/2001 | Beirise |
| 2002/0053174 | A1 | 5/2002 | Barmark |
| 2002/0108330 | A1 | 8/2002 | Yu |
| 2002/0121056 | A1 | 9/2002 | Von Hoyningen |
| 2002/0124514 | A1 | 9/2002 | Higgins |
| 2002/0129574 | A1 | 9/2002 | Newhouse |
| 2002/0144476 | A1 | 10/2002 | Mastelli |
| 2002/0157335 | A1 | 10/2002 | Vos |
| 2003/0005514 | A1 | 1/2003 | Kunkel |
| 2003/0060080 | A1 | 3/2003 | Rees |
| 2003/0089057 | A1 | 5/2003 | Wiechecki |
| 2003/0154673 | A1 | 8/2003 | Macgregor |
| 2003/0196388 | A1 | 10/2003 | Edwards |
| 2003/0221384 | A1 | 12/2003 | Burken |
| 2004/0010998 | A1 | 1/2004 | Turco |
| 2004/0020137 | A1 | 2/2004 | Battey |
| 2004/0035074 | A1 | 2/2004 | Stanescu |
| 2004/0093805 | A1 | 5/2004 | Underwood |
| 2004/0177573 | A1 | 9/2004 | Newhouse |
| 2005/0005527 | A1 | 1/2005 | Metcalf |
| 2005/0086871 | A1 | 4/2005 | MacGregor |
| 2006/0042141 | A1 | 3/2006 | Hansen |
| 2006/0048457 | A1 | 3/2006 | Yang |
| 2006/0059806 | A1 | 3/2006 | Gosling |
| 2006/0185276 | A1 | 8/2006 | Pai |
| 2007/0277449 | A1 | 12/2007 | Burns |
| 2007/0289225 | A1 | 12/2007 | Kern |
| 2008/0069632 | A1 | 3/2008 | Gosling |
| 2008/0295426 | A1 | 12/2008 | Milligan |
| 2008/0302054 | A1 | 12/2008 | Gosling |
| 2009/0021122 | A1 | 1/2009 | Green |
| 2009/0241437 | A1 | 10/2009 | Steinle |
| 2009/0260311 | A1 | 10/2009 | Boyer |
| 2009/0293406 | A1 | 12/2009 | Gosling |
| 2010/0043142 | A1 | 2/2010 | Whitford |
| 2010/0192511 | A1 | 8/2010 | Gosling |
| 2010/0223857 | A1 | 9/2010 | Sutton |
| 2010/0307086 | A1 | 12/2010 | Hibbs |
| 2011/0113692 | A1* | 5/2011 | Stamper ..... A01K 31/02 49/334 |
| 2011/0197519 | A1 | 8/2011 | Henriott |
| 2012/0186164 | A1 | 7/2012 | Pensi |
| 2012/0317899 | A1 | 12/2012 | Von Hoyningen Huene |
| 2014/0102021 | A1 | 4/2014 | Gosling |
| 2014/0202361 | A1* | 7/2014 | Siwiec ..... A47B 5/06 108/48 |
| 2014/0310873 | A1* | 10/2014 | Gosling ..... A47B 5/04 5/136 |
| 2014/0338120 | A1* | 11/2014 | Baugh ..... A47B 83/04 5/3 |
| 2015/0007516 | A1 | 1/2015 | Glick |
| 2015/0354212 | A1 | 12/2015 | Von Hoyningen Huene |
| 2016/0032644 | A1 | 2/2016 | Geller |
| 2016/0053485 | A1 | 2/2016 | Von Hoyningen Huene |

FOREIGN PATENT DOCUMENTS

| | | |
|---|---|---|
| CA | 2011977 | 10/1990 |
| CA | 2002674 | 5/1991 |
| CA | 2040822 | 11/1991 |
| CA | 2162300 | 5/1997 |
| CA | 2273631 | 10/2001 |
| CA | 2324050 | 4/2002 |
| CA | 2348060 | 11/2002 |
| CA | 2359165 | 4/2003 |
| CA | 2310869 | 8/2003 |
| CA | 2476368 | 1/2006 |
| CA | 2359547 | 2/2008 |
| CA | 2428593 | 8/2008 |
| CA | 2591176 | 12/2008 |
| CA | 2634407 | 12/2008 |
| CA | 2349964 | 10/2009 |
| CA | 2840843 | 12/2013 |

(56) References Cited

FOREIGN PATENT DOCUMENTS

| | | |
|---|---|---|
| CA | 2535213 | 4/2014 |
| CA | 2863783 | 4/2014 |
| CH | 686795 | 6/1996 |
| CN | 202069245 | 12/2011 |
| DE | 1659015 | 11/1971 |
| DE | 4207753 | 9/1993 |
| DE | 69316247 | 7/1998 |
| DE | 19960535 | 6/2001 |
| DE | 202004017808 | 1/2005 |
| EP | 0302564 | 2/1989 |
| EP | 0443202 | 8/1991 |
| EP | 0557092 | 1/1998 |
| EP | 0963719 | 12/1999 |
| EP | 1094167 | 4/2001 |
| EP | 2736382 | 6/2014 |
| FR | 1526637 | 5/1968 |
| GB | 1259347 | 1/1972 |
| GB | 1400613 | 7/1975 |
| GB | 2221946 | 2/1990 |
| GB | 2283071 | 4/1995 |
| GB | 2353541 | 10/2003 |
| JP | O317333 | 1/1991 |
| JP | 2003105908 | 4/2003 |
| JP | 2005155223 | 6/2005 |
| KR | 20000049102 | 7/2000 |
| KR | 1020070077502 | 7/2007 |
| WO | 9212074 | 7/1992 |
| WO | 9212300 | 7/1992 |
| WO | 9315970 | 8/1993 |
| WO | 9323629 | 11/1993 |
| WO | 9402695 | 2/1994 |
| WO | 9633323 | 10/1996 |
| WO | 9746770 | 12/1997 |
| WO | 9807357 | 2/1998 |
| WO | 9816699 | 4/1998 |
| WO | 9829623 | 7/1998 |
| WO | 9837292 | 8/1998 |
| WO | 9851876 | 11/1998 |
| WO | 9946453 | 9/1999 |
| WO | 9946455 | 9/1999 |
| WO | 9946458 | 9/1999 |
| WO | 9953156 | 10/1999 |
| WO | 9958780 | 11/1999 |
| WO | 9963177 | 12/1999 |
| WO | 0015918 | 3/2000 |
| WO | 0075447 | 12/2000 |
| WO | WO0171241 | 9/2001 |
| WO | 0208851 | 1/2002 |
| WO | 02052111 | 4/2002 |
| WO | 02103129 | 12/2002 |
| WO | WO03071045 | 8/2003 |
| WO | WO2003071045 | 8/2003 |
| WO | WO03104581 | 12/2003 |
| WO | WO2003104581 | 12/2003 |
| WO | 2005120294 | 12/2005 |
| WO | 2006127804 | 11/2006 |
| WO | 2010121788 | 10/2010 |
| WO | 2012173930 | 12/2012 |
| WO | 2013101298 | 7/2013 |
| WO | 2013130871 | 9/2013 |
| WO | 2013185141 | 12/2013 |
| WO | 2013188211 | 12/2013 |
| WO | 2013188235 | 12/2013 |
| WO | 2014039278 | 3/2014 |
| WO | 2014055883 | 4/2014 |

OTHER PUBLICATIONS

Restriction Requirement for U.S. Appl. No. 14/683,684 dated Oct. 5, 2017.

Notice of Allowance for U.S. Appl. No. 29/493,280 dated Jan. 21, 2016.

Canadian Office Action for Application No. 2,800,414 dated Jul. 15, 2015.

Genius Architectural Walls, [Publication Date Unlisted], Copyright Date 2004 by KI, Document Code KI-00473/HC/IT/PP/504.

KI Improves STC Rating on its Genius Architectural Wall and receives ICC approval, [Publication Date Unlisted], Dated Feb. 26, 2004.

Lifespace Environmental Wall Systems, [Publication Date Unlisted], Dated Apr. 1995.

Press Release—"KI unveils Genius Full Heigth Movable Wall Microsite with new interactive features", Accessed on Aug. 14, 2015 at http://web.archive.org/web/20040506230219/http://www/ki.com/about_press_release.asp?id=49.

Office Insight, [Publication Date Unlisted], Dated Mar. 23, 2009.

KI Genius Full-Height Moveable Walls, [Publication Date Unlisted], Copyright Date 2003 by KI, Document Code KI-00506/HC/PP/803.

U.S. Specifier Guide and Price Book, [Publication Date Unlisted], Dated Jan. 1998.

Achieving the Atkins Aesthetic: KI's new ThinLine option for its award-winning Genius Architectural Wall flaunts a slimmer figure, [Publication Date Unlisted], Dated Jun. 14, 2004.

SMED International—Lifespace—Technical Information, [Publication Date Unlisted], Dated Jan. 1, 1996.

Teknionaltos—Price and Product Guide Update, [Publication Date Unlisted], Dated Feb. 2002.

International Search Report and Written Opinion for PCT/US2012/042314 dated Jun. 13, 2012.

International Preliminary Report on Patentability for application PCT/US2012/042314 dated Jul. 10, 2014.

International Search Report for application No. EP17189630.1 dated Dec. 12, 2017.

Non-Final Office Action for U.S. Appl. No. 15/177,084 dated Jan. 29, 2018.

* cited by examiner

EMBEDDED FURNITURE HAVING RETRACTIBLE LEGS WITH LIGHTING

CROSS-REFERENCE TO RELATED APPLICATIONS

The present application claims the benefit of priority to U.S. Provisional Patent Application No. 62/293,568, filed on Feb. 10, 2016, entitled "Embedded Furniture having Retractable Legs with Lighting," and to U.S. Provisional Patent Application No. 62/293,573, filed on Feb. 10, 2016, entitled "Modular Wall with Embedded Furniture and Opposing Feature," the entire content of each of which is incorporated herein by reference.

BACKGROUND

1. Technical Field

This disclosure generally relates to embedded furniture systems. More specifically, the present disclosure relates to (modular) wall-embedded furniture systems including, without limitation, recessed, extendable furniture, such as beds, tables, desks, sofas, and chairs.

2. Related Technology

Building space can be relatively expensive due to the basic costs associated with the location and size of the building. In addition to these costs, furnishing the interior space may add further expense. In a residential setting, for example, an owner or occupant may not be able to afford the size of residence they need and purchase furniture to fill the entire house. Similarly, in a commercial setting, sufficient floor space in an office building or warehouse may not be available within certain price ranges.

Wall beds (i.e., Murphy beds) or other embedded furniture may be built into an interior wall or provided within a separate piece of furniture, such as a bookcase. Such embedded furniture may be selectively positionable between an upright or substantially vertical storage position and an extended or substantially horizontal utility position. In the utility position, the furniture may be disposed above the floor to provide an elevated functional configuration. For instance, a wall bed or table may be pulled down so as not to rest entirely on the floor. Embedded seating (chairs, couches, benches, etc.), work stations (desks, tables, countertops, etc.), decorative, display, or storage furniture (e.g., a cabinet, drawer, buffet, shelf, etc.), and so forth may similarly be positioned above the floor.

To rest above the floor, embedded furniture may need a separate support structure (e.g., one or more legs). Without the support structure, the retracting mechanism may be damaged as the furniture is strained by the weight of the extended furniture or over-extended beyond the intended resting utility position. Such support structures, however, may be cumbersome, unsightly, or aesthetically unappealing during use and/or storage of the embedded furniture. Moreover, additional storage space may be required to store the support structure during non-use.

Accordingly, there are a number of disadvantages with conventional embedded furniture systems that can be addressed.

BRIEF SUMMARY

Implementations of the present disclosure solve one or more of the foregoing or other problems in the art with systems, methods, and apparatus for incorporating selectively retractable support structures into extendable furniture elements (e.g., beds, tables, seating, work stations, decorative, display, or storage furniture, etc.). In an implementation, a furniture element can be connected to a structural component, (e.g., a modular or non-modular wall element or stand-alone feature, such as a furniture element) and/or selectively moveable between a storage position and a utility position. In the utility position, the furniture element can extend from the structural component. The structural component can have a furniture stowage (or storage) pocket recessed therein. In the storage position, the furniture element can be disposed at least partially within the pocket and/or adjacent to the structural component.

In one or more implementations, an embedded furniture system can include a furniture element selectively moveable between (i) a stowage (or storage) position (e.g., in which the furniture element is disposed in a pocket, in a substantially upright or vertically orientation, and/or substantially parallel to the (front, display surface of the) structural component) and (ii) a utility (or deployed) position (e.g., in which the furniture element extends from the pocket or structural component, in a substantially horizontal orientation, and/or substantially perpendicular to the (front, display surface of the) structural component). The furniture element can be moveably (e.g., hingedly) connected to the structural component.

In at least one implementation, a furniture (and/or wall) system can include a support structure (e.g., for supporting the furniture element above a floor when the furniture element is in the utility position). The support structure can include one or more (independently actuatable) legs or other supports and/or can be moveably (e.g., hingedly) connected to the furniture element or an outer wall surface thereof. The support structure can be selectively positionable between an extended position (e.g., in which the support structure protrudes substantially perpendicular to the furniture element or the outer wall surface thereof) and a retracted position (e.g., in which the support structure extends substantially parallel to the furniture element or the outer wall surface thereof).

A lighting element can be disposed on or in the support structure in some implementations. An illuminating mechanism can illuminate the lighting element (e.g., when the support structure is in the retracted position). In certain implementations, the illuminating mechanism includes a circuit element (e.g., connected to a (longitudinal, inner) surface of the support structure) and/or a contact element (e.g., connected to the outer wall surface of the furniture element). When the support structure is disposed in the retracted position, the circuit element can communicate with the contact element to complete an electrical circuit sufficient to illuminate the lighting element. When the support structure is disposed in the extended position, however, the circuit element can be separated from the contact element, such that the electrical circuit is incomplete, and the lighting element is not illuminated.

Accordingly, a method of stowing extendable furniture can include (hingedly) actuating a furniture element from a utility position to a storage position. The furniture element can be in a generally horizontal orientation in the utility position and/or a generally vertical orientation in the storage position. The method can include (hingedly) actuating a support structure from an extended position into a retracted position. The support structure can be connected to an outer wall surface of the furniture element. Hingedly actuating the support structure into the retracted position can illuminate a lighting element disposed on or in the support structure (e.g., by bringing a contact element (e.g., connected to the surface of the furniture element) into communication with a circuit element (e.g., connected to the surface of the support structure) to complete an electrical circuit).

This summary is provided to introduce a selection of concepts in a simplified form that are further described below in the Detailed Description. This Summary is not intended to identify key features or essential features of the claimed subject matter, nor is it intended to be used as an indication of the scope of the claimed subject matter.

Additional features and advantages of the disclosure will be set forth in the description which follows, and in part will be obvious from the description, or may be learned by the practice of the disclosure. The features and advantages of the disclosure may be realized and obtained by means of the instruments and combinations particularly pointed out in the appended claims. These and other features of the present disclosure will become more fully apparent from the following description and appended claims, or may be learned by the practice of the disclosure as set forth hereinafter.

BRIEF DESCRIPTION OF THE DRAWINGS

In order to describe the manner in which the above-recited and other advantages and features of the disclosure can be obtained, a more particular description of the disclosure briefly described above will be rendered by reference to specific implementations thereof, which implementations are illustrated in the appended drawings. It should be noted that the figures are not, necessarily, drawn to scale. Understanding that these drawings depict only typical implementations of the disclosure and are not, therefore, to be considered to be limiting of its scope, the disclosure will be described and explained with additional specificity and detail through the use of the accompanying drawings in which.

DETAILED DESCRIPTION

Figure 1A:
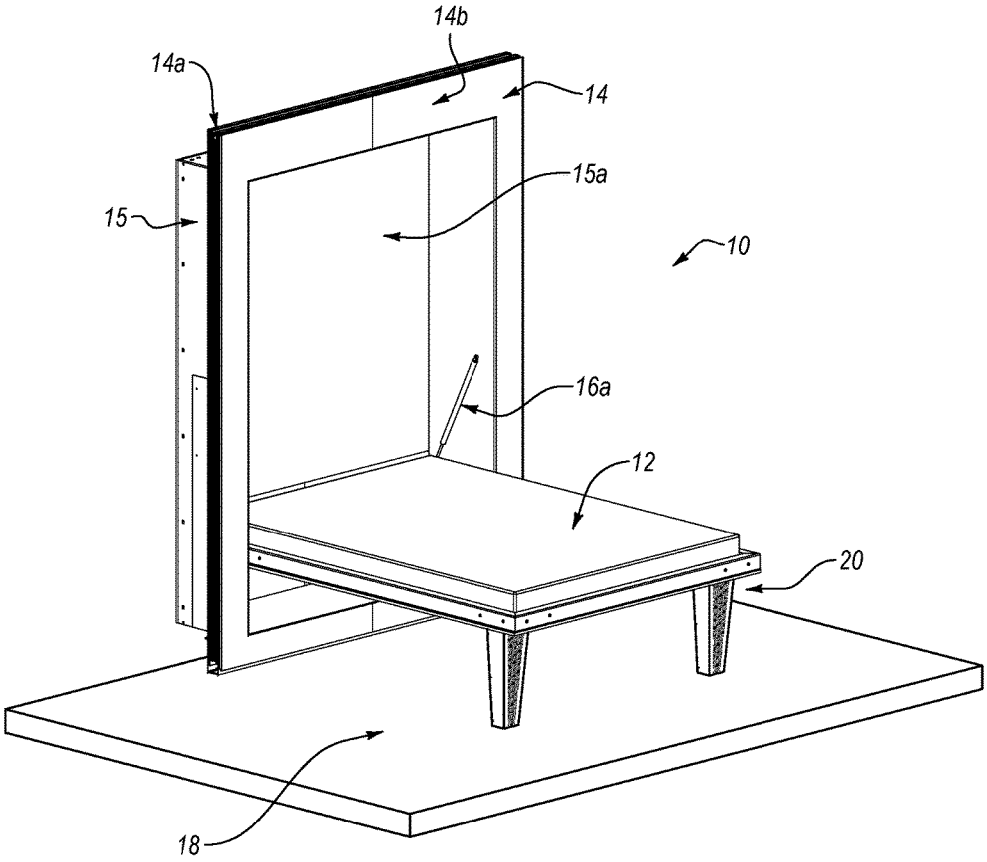
FIG. 1A illustrates a front perspective view of an embedded furniture system in a utility configuration according to an implementation of the present disclosure.

Before describing various implementations of the present disclosure in detail, it is to be understood that this disclosure is not limited to the parameters of the particularly exemplified systems, methods, apparatus, products, processes, and/or kits, which may, of course, vary. Thus, while certain implementations of the present disclosure will be described in detail, with reference to specific configurations, parameters, features (e.g., components, members, elements, parts, and/or portions), etc., the descriptions are illustrative and are not to be construed as limiting the scope of the claimed invention. In addition, the terminology used herein is for the purpose of describing the implementations, and is not necessarily intended to limit the scope of the claimed invention.

Unless defined otherwise, all technical and scientific terms used herein have the same meaning as commonly understood by one of ordinary skill in the art to which the present disclosure pertains.

Various aspects of the present disclosure, including devices, systems, and methods may be illustrated with reference to one or more embodiments or implementations, which are exemplary in nature. As used herein, the terms "embodiment" and "implementation" mean serving as an example, instance, or illustration, and should not necessarily be construed as preferred or advantageous over other aspects disclosed herein. In addition, reference to an "implementation" of the present disclosure or invention includes a specific reference to one or more embodiments thereof, and vice versa, and is intended to provide illustrative examples without limiting the scope of the invention, which is indicated by the appended claims rather than by the following description.

As used herein, the term "systems" also contemplates devices, apparatus, compositions, assemblies, kits, and vice versa. Similarly, the term "method" also contemplates processes, procedures, steps, and vice versa. Moreover, the term "devices" also contemplates products, apparatus, compositions, assemblies, kits, and vice versa.

As used throughout this application the words "can" and "may" are used in a permissive sense (i.e., meaning having the potential to), rather than the mandatory sense (i.e., meaning must). Additionally, the terms "including," "having," "involving," "containing," "characterized by," as well as variants thereof (e.g., "includes," "has," and "involves," "contains," etc.), and similar terms as used herein, including the claims, shall be inclusive and/or open-ended, shall have the same meaning as the word "comprising" and variants thereof (e.g., "comprise" and "comprises"), and do not exclude additional, un-recited elements or method steps, illustratively.

It will be noted that, as used in this specification and the appended claims, the singular forms "a," "an" and "the" include plural referents unless the context clearly dictates otherwise. Thus, for example, reference to a "seam" includes one, two, or more seams. Similarly, reference to a plurality of referents should be interpreted as comprising a single referent and/or a plurality of referents unless the content and/or context clearly dictate otherwise. Thus, reference to "seams" does not necessarily require a plurality of such seams. Instead, it will be appreciated that independent of conjugation; one or more seams are contemplated herein.

As used herein, directional, positional, and/or orientational terms, such as "top," "bottom," "left," "right," "up," "down," "upper," "lower," "inner," "outer," "internal," "external," "interior," "exterior," "proximal," "distal" and so forth can be used arbitrarily and/or solely to indicate relative directions, positions, and/or orientations and may not be otherwise intended to limit the scope of the disclosure, including the specification, drawings, and/or claims.

Various aspects of the present disclosure can be illustrated by describing components that are bound, coupled, attached, connected, and/or joined together. As used herein, the terms "bound," "coupled", "attached", "connected," "joined," "communicating," or "in communication" are used to indicate either a direct association between two components or, where appropriate, an indirect association with one another through intervening or intermediate components. In contrast, when a component is referred to as being "directly bound," "directly coupled", "directly attached", "directly connected," "directly joined," "directly communicating," or "in direct communication" to or with another component, no intervening elements are present or contemplated. Furthermore, binding, coupling, attaching, connecting, joining, or communicating can comprise mechanical and/or electrical association.

To facilitate understanding, like reference numerals (i.e., like numbering of components and/or elements) have been used, where possible, to designate like elements common to the figures. Specifically, in the exemplary implementations illustrated in the figures, like structures, or structures with like functions, will be provided with similar reference designations, where possible. Specific language will be used herein to describe the exemplary implementations. Nevertheless it will be understood that no limitation of the scope of the disclosure is thereby intended. Rather, it is to be understood that the language used to describe the exemplary implementations is illustrative only and is not to be construed as limiting the scope of the disclosure (unless such language is expressly described herein as essential).

Furthermore, alternative configurations of a particular element may each include separate letters appended to the element number. Accordingly, an appended letter can be used to designate an alternative design, structure, function, implementation, and/or embodiment of an element or feature without an appended letter. Similarly, multiple instances of an element and/or sub-elements of a parent element may each include separate letters appended to the element number. In each case, the element label may be used without an appended letter to generally refer to instances of the element or any one of the alternative elements. Element labels including an appended letter can be used to refer to a specific instance of the element or to distinguish or draw attention to multiple uses of the element. However, element labels including an appended letter are not meant to be limited to the specific and/or particular implementation(s) in which they are illustrated. In other words, reference to a specific feature in relation to one implementation and/or embodiment should not be construed as being limited to applications only within said implementation.

The headings used herein are for organizational purposes only and are not meant to be used to limit the scope of the description or the claims.

The present disclosure extends to systems, methods, and apparatus for incorporating furniture (e.g., beds, tables, seating, work stations, decorative, display, or storage furniture, etc.) into walls and/or stand-alone features. In particular, one or more implementations include an embedded furniture system with a structural component (e.g., modular or non-modular wall element or stand-alone furniture element) having a recessed, extendable furniture component incorporated therein. For instance, the structural component can have a pocket (or socket) recessed therein, with a socket component that (at least partially) bounds a stowage cavity for receiving the extendable furniture. The extendable furniture can move between a closed, storage or stowage position and an open or extended utility or deployed position. When in the storage position, the furniture can be substantially concealed within the wall or recessed pocket.

Moreover, the system can be configured to support the furniture above the floor in the utility position with one or more extendable supports connected to the furniture. The supports can (hingedly) actuate away from the surface of the furniture (e.g., to extend substantially perpendicular thereto), providing ample support (e.g., for the weight of one or more users). In the storage configuration, the furniture can fold into the recessed pocket and the supports can (independently) fold against the surface of the furniture. A contact (plate) on the surface of the furniture can complete an electrical circuit of an illuminating mechanism to illuminate a lighting element on or inside the supports. When the furniture is deployed again, the circuit can be broken to turn the lighting element off or vice versa.

The recessed, extendable furniture can comprise a bed, a shelf, a desk, bunk beds, a chair, a table, or other furniture. Indeed, one will appreciate in light of the disclosure herein that the systems, apparatus, and methods can allow incorporation of a wide variety of furniture (e.g., within a (modular) wall or and/or stand-alone feature). In particular, implementations of the present disclosure can provide aesthetic appeal to attached support members so that the supports appear as wall lighting (e.g., sconces) when the furniture is stored in the recessed wall socket.

Some implementations can also include a wall or wall element (e.g., for concealing a portion of the system, such as the structural component and/or socket component). In at least one implementation, a wall element can be provided or included to conceal the structural component and/or a concealing element, such as a (substantially hollow, artificial) furniture component (or covering) can be provided or included to conceal the back side of the socket component. The furniture component can comprise any type of furniture suitable and/or amenable to substantially concealing an understructure. For instance, the opposing furniture component can comprise a covering that resembles (the exterior of) a (substantially block) piece of furniture. Such block furniture can include, for example, a drawer, buffet, cabinet, couch, loveseat, chair, or other furniture capable of concealing matter therein.

In certain implementations, the concealing element can substantially conceal the body of the stowage compartment (or socket) such that the wall component need not be sized to conceal the socket. For instance, the wall element can be sized according to industry standards for interior walls, instead of being thicker to conceal the socket component. Accordingly, implementations of the present disclosure can have an artificial or false furniture component that covers the rear body portion of a recessed furniture socket. Thus, implementations of the present disclosure can provide aesthetic appeal to embedded furniture systems so that the wall to which the embedded furniture element is attached need not be thick enough to conceal the socket, without the socket being exposed on the opposing side of the wall.

In at least one implementation, a furniture system can include an actuating mechanism connected between the furniture element and the structural component. The actuating mechanism can provide a mechanical advantage for moving the furniture element from the utility position into the storage position. In certain implementations, the actuating mechanism comprises a hinge element, such as a (gas) piston, spring, shock, or strut, connected to the furniture element and the structural component. The actuating mechanism can also comprise an (electric) actuating member (or motor) configured to selectively move the furniture element between the utility position and the storage position. In certain implementations, at least a portion of the actuating mechanism can be substantially concealed and/or disposed outside the recessed pocket. For instance, the hinge element and/or actuating member can be disposed within the concealing element and/or opposite the recessed pocket, such as between the concealing element and the outer surface of the socket component.

Throughout this specification, reference may be made to wall modules or modular wall systems. A wall module can comprise an individual section of the modular wall system which a manufacturer can attach and remove independently of other wall module sections of the modular wall system. For example, an existing installed wall system that does not include a wall module having recessed, extendable furniture may be retrofitted with a wall module having recessed, extendable furniture according to one or more implementations of the present disclosure. In particular, a user can replace an existing wall module in the installed wall without requiring the disassembly of the entire wall system. In addition, a wall module itself can be or comprise an embedded furniture system.

The disclosure, however, is not limited to retrofitting existing walls, but also extends to modular wall installations that include wall modules having recessed, extendable furniture at the time of initial installation. Furthermore, implementations extend to non-modular wall, permanent wall and/or stand-alone furniture systems, apparatus, and methods incorporating embedded furniture therein. Accordingly, reference to one or more walls, wall components, wall elements, or similar features includes a specific reference to modular, non-modular, and permanent walls, wall components, wall elements, etc. and/or stand-alone furniture, stand-alone furniture components, stand-alone furniture elements, etc.

Figure 1B:
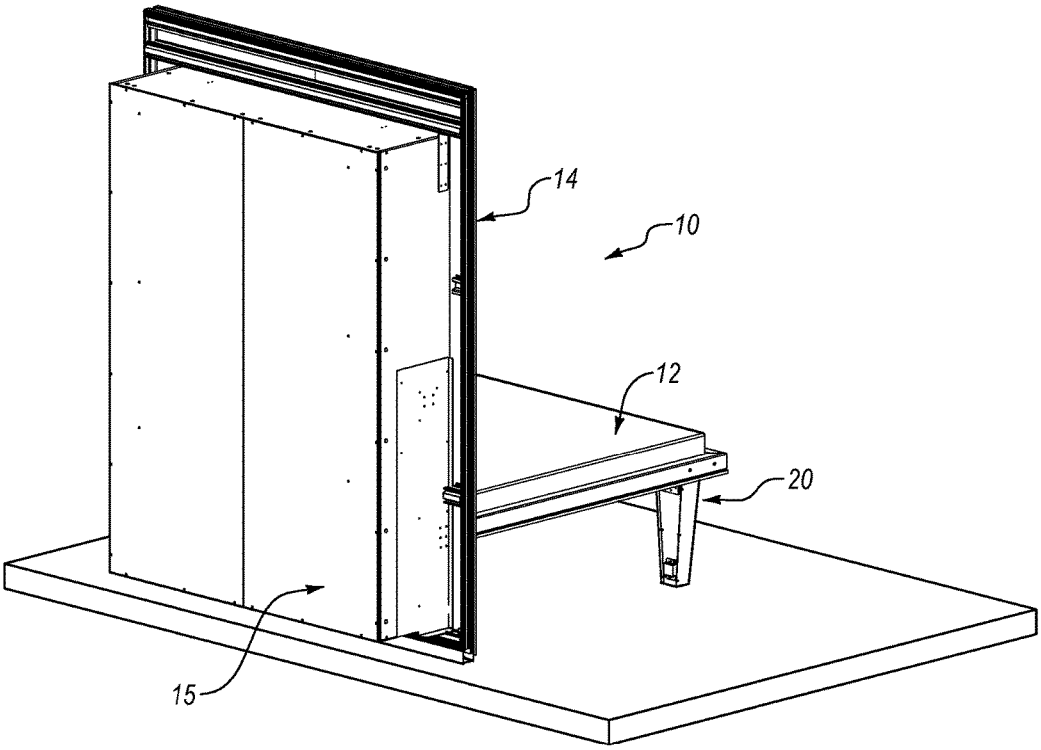
FIG. 1B illustrates a rear perspective view of the embedded furniture system of FIG. 1A.

Reference will now be made to the figures of the present disclosure. FIG. 1A and FIG. 1B illustrate an embedded furniture system 10 in a utility configuration according to an implementation of the present disclosure. Embedded furniture system 10 can comprise a furniture assembly that includes a furniture stowage component 15 having a recessed (furniture) compartment, pocket, or socket 15*a* and a furniture element 12 extending from stowage component 15. Stowage component 15, or an inner surface thereof, can form, define, or at least partially bound pocket 15*a*.

In at least one implementation, the furniture assembly can extend through a structural component 14. Structural component 14 can comprise a (modular or permanent) wall assembly, comprising, for example, a structural (or frame) element 14*a* (e.g., to which stowage component 15 can be mounted) and/or a display (or outer wall) element and/or surface 14*b* (e.g., attached to structural (or frame) element 14*a*).

In some implementations, structural component 14, structural (or frame) element 14*a*, and/or display element and/or surface 14*b* can comprise a modular wall component configured to integrate the furniture assembly into a modular wall system. For instance, the modular wall component can be incorporated into a wall module or modular wall system thereof. Accordingly, embedded furniture system 10 can extend through and/or include a structural wall component in one or more embodiments. Thus, structural component 14 can be incorporated into an interior wall of a building space or have walls extending therefrom. Alternatively, structural component 14 can comprise a stand-alone feature, such as a bookshelf, armoire, etc.

As indicated above, embedded furniture system 10 can also include a selectively extendable piece of furniture or furniture element 12. As depicted, furniture element 12 comprises an extendable bed. It will be appreciated, however, that furniture element 12 can also (or alternatively) comprise seating (chairs, couches, benches, etc.), work stations (desks, tables, countertops, etc.), decorative, display, or storage furniture (e.g., a cabinet, drawer, buffet, shelf, etc.), or any suitable piece(s) of (embeddable) furniture.

Furniture element 12 can be moveably connected to structural component 14. For instance, an actuating mechanism 16*a* can provide movability and/or mechanical advantage in stowing furniture element 12 into socket 15*a* (by raising or lifting up (on a front end of) furniture element 12). The actuating mechanism 16*a* can include one or more (e.g., opposing) hinge elements, which can direct furniture element 12 (or component(s) thereof) into a proper storage position. The actuating mechanism 16*a* can also include one or more springs, (gas) pistons, shocks, struts, and/or other biasing members for providing mechanical advantage.

The embedded furniture system 10 can also include a structural support element 20 connected to and/or extending (perpendicularly from) furniture element 12. Structural support element 20 can support furniture element 12 above floor 18 when furniture element 12 is in the extended, utility position illustrated in FIGS. 1A-2.

Figure 2:
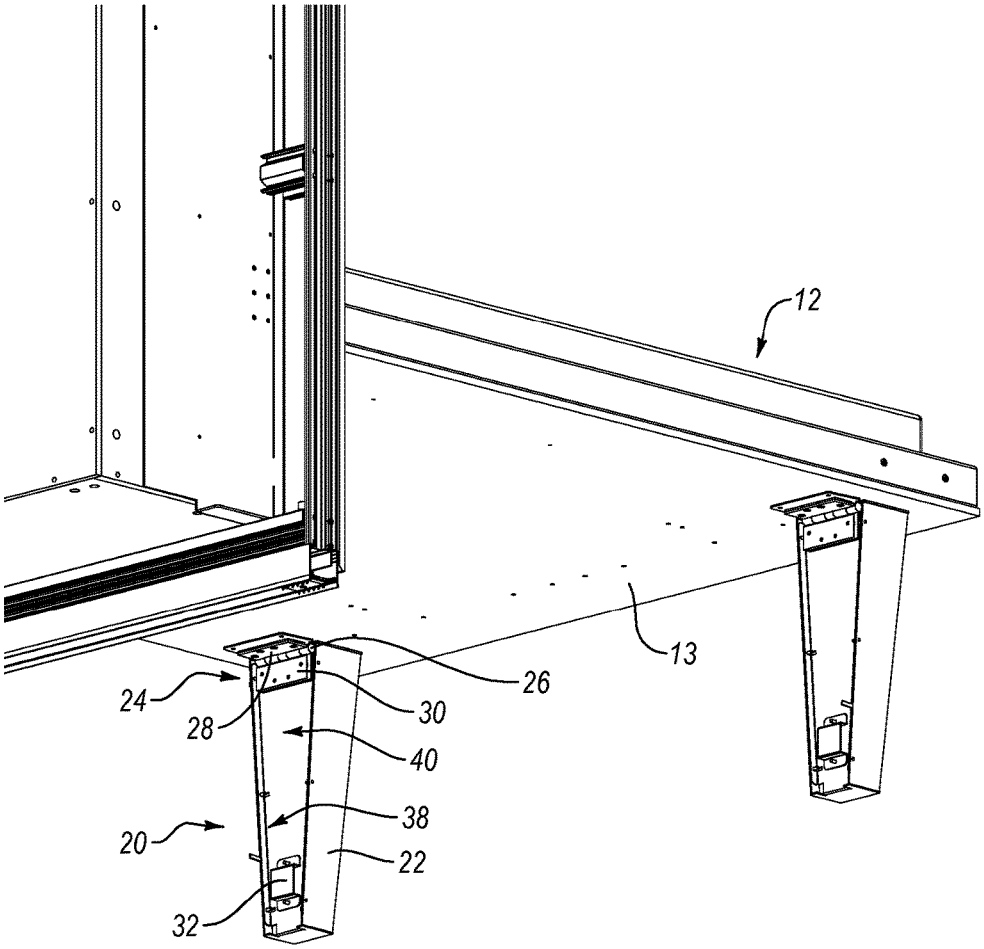
FIG. 2 illustrates a detailed perspective view of a structural support element of the embedded furniture system of FIG. 1A in an extended configuration.

As illustrated in FIG. 2, structural support element 20 can include two support legs 22 and/or can be connected to furniture element 12 (or outer wall surface 13 thereof) by an attachment mechanism 24. Attachment mechanism 24 can comprise a hinge element or any other suitable means for attaching structural support element 20 (or support legs 22 thereof) to furniture element 12 (or outer wall surface 13 thereof). In the depicted implementation, for instance, attachment mechanism 24 includes a hinge connection 26, a first connection element 28 extending from hinge connection 26 and connected to furniture element 12 (or outer wall surface 13 thereof), and a second connection element 30 extending from hinge connection 26 and connected to structural support element 20 (or support legs 22 thereof, such as on an inner (contact) surface 40). Structural support element 20 can also include a contact bracket 32 (e.g., attached to structural support element 20 (or support legs 22 thereof, such as on an inner (contact) surface 40)). Contact bracket 32 can be configured to ensure that support leg 22 folds into a correct, predetermined position relative to surface 13 and/or does not substantially damage surface 13 upon (repeated) contact therewith.

In at least one implementation, structural support element 20 includes a lighting element 38 connected thereto or disposed at least partially thereon or therein. Lighting element 38 can include one or more LED or other illuminating elements (not shown). Certain implementations can also include an illuminating mechanism (e.g., that illuminates the lighting element or the illuminating element thereof. For instance, attachment mechanism 24 can (also) comprise, form, or be a component of the illuminating mechanism. In particular, in one or more implementations, second connection element 30 can (also or alternatively) be or comprise a circuit element connected to lighting element 38 or the illuminating element thereof, as well as a power source (e.g., electrical wiring, battery, etc.). It will be appreciated, however, that the circuit element can be separate from and/or need not be connected to second connection element 30 in certain implementations.

In at least one implementation, the circuit element (of second connection element 30) can be or comprise an opened or incomplete circuit (configuration) when structural support element 20 (or support leg 22 thereof) is in the extended position (e.g., wherein support leg 22 and/or second connection element 30 is moved away from furniture element 12 (or outer wall surface 13 thereof), as depicted in FIG. 2. In particular, first connection element 28 can be or comprise a contact element in some implementations. Alternative contact elements (e.g., not associated with or connected to first connection element 28) are also contemplated herein.

The contact element (of first connection element 28) can close or complete the electrical circuit of the illuminating mechanism (e.g., when structural support element 20 (or support leg 22 thereof) is moved against furniture element 12 (or outer wall surface 13 thereof), in the retracted position). In particular, when first connection element 28 is brought into contact or communication with second connection element 30, the circuit of the illuminating mechanism can be completed to illuminate lighting element 38 or the illuminating element thereof. It will be appreciated, however, that the connection element need not be connected to first connection element 28 in certain implementations. Lighting element 38 or the illuminating element thereof can also be electrically coupled to a power source or supply, such as a battery or electric wire.

Figure 3A:
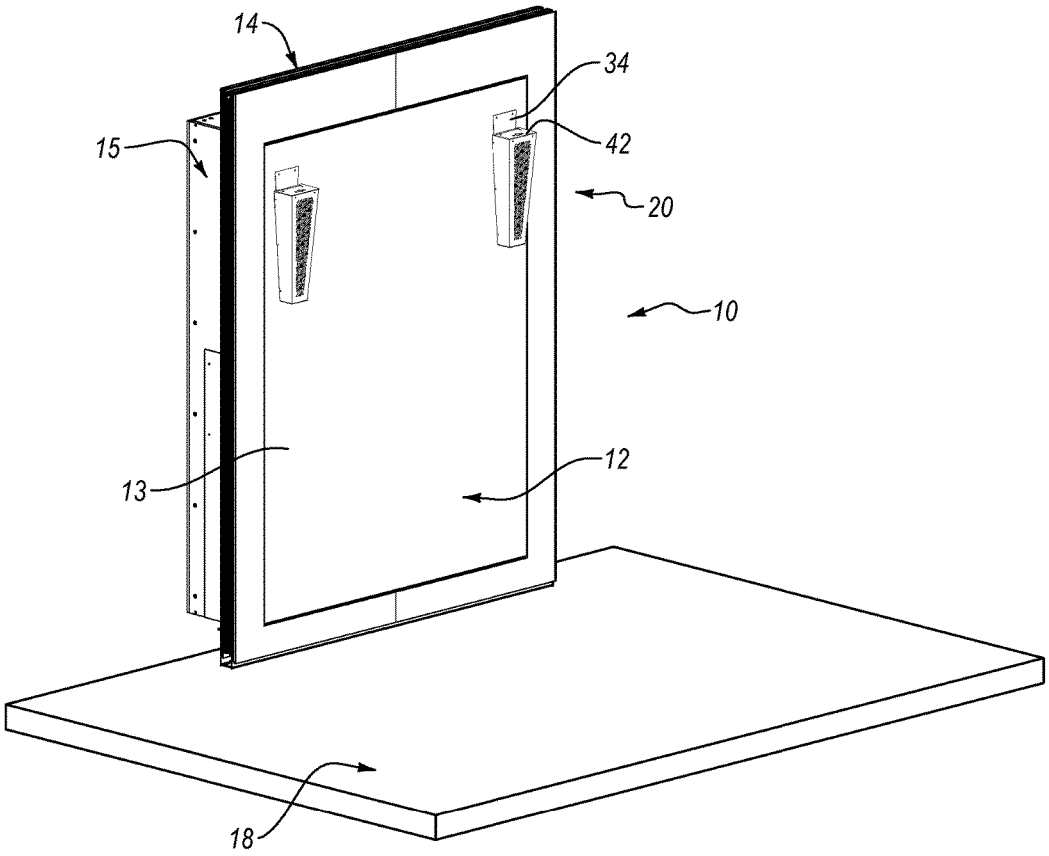
FIG. 3A illustrates a front perspective view of the embedded furniture system of FIG. 1A in a storage configuration.

As illustrated in FIG. 3A, system 10 can be moved into a closed configuration in which furniture element 12 is folded or actuated (upward) until it is disposed in a stowed (or stored) position (substantially within socket 15). Structural support element 20 can also be actuated (downward—against surface 13) into a retracted position. In the illustrated retracted position, first connection element 28 (FIG. 2) is brought into contact or communication with second connection element 30 (FIG. 2) and the circuit of the illuminating mechanism is completed, thereby illuminating lighting element 38 (FIG. 2) or the illuminating element thereof.

Figure 3B:
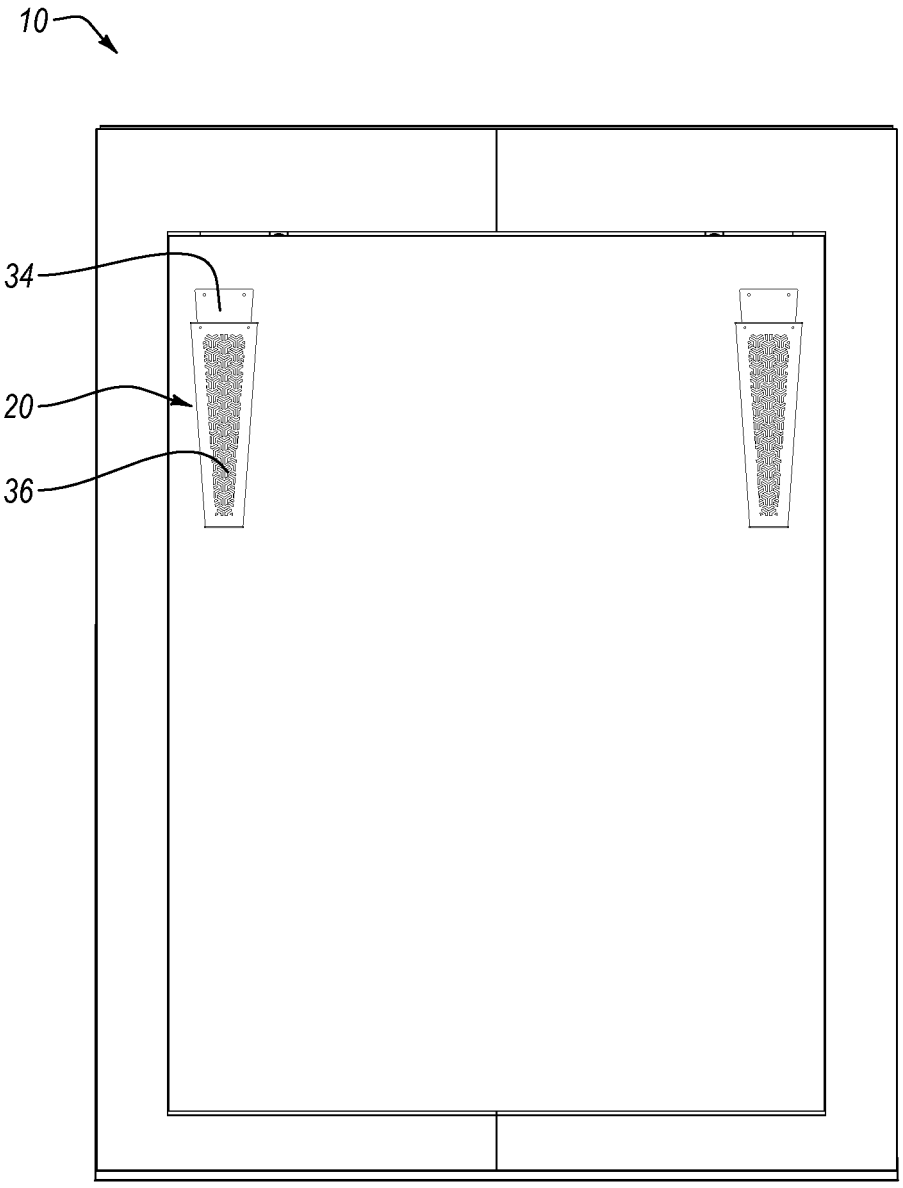
FIG. 3B illustrates a front elevation view of the embedded furniture system of FIG. 3A.

FIGS. 3A-3B also illustrate a third connection element 34 (disposed on and/or connected to surface 13 of furniture element 12). FIG. 3A also illustrates a fourth connection element 42 (disposed on and/or connected to (the top surface of) structural support element 20). In at least one implementation, third connection element 34 and fourth connection element 42 can similarly complete an electrical circuit when brought into communication one with another. Accordingly, structural support element 20 (or lighting element 38 thereof) can include a second illuminating element or mechanism. In certain implementations, when structural support element 20 is in the extended position, as illustrated in FIGS. 1A-2, lighting element 38 can be illuminated in a night-light setting. However, when structural support element 20 is disposed in the retracted position, as illustrated in FIG. 3A, lighting element 38 can be illuminated in a day-light setting (brighter than the night-light setting).

Alternatively, the different illuminating elements or mechanisms can comprise different colors of light or different lighting characteristics, such as flickering, glowing, flashing, etc. In at least one implementation, one or more illuminating elements or mechanisms can be selectable or have a selective feature or parameter. For instance, lighting element 38 can be controllable by a dimmer or other lighting switch (not shown) (e.g., when structural support element 20 is in the extended position, as illustrated in FIGS. 1A-2, or retracted position, as illustrated in FIGS. 3A-3B). In other embodiments, a selection mechanism (not shown) can allow the color or characteristic of the lighting element 20 to be selectively changed (e.g., when structural support element 20 is in the extended position, as illustrated in FIGS. 1A-2, or retracted position, as illustrated in FIGS. 3A-3B).

Third connection element 34 and/or fourth connection element 42 can also or alternatively comprise a magnetic element in certain implementations. Accordingly, structural support element 20 can be magnetically retained and/or maintained in the extended position illustrated in FIGS. 1A-2 by means of magnetic forces between third connection element 34 and fourth connection element 42. First connection element 28 and/or second connection element 30 can similarly include a magnetic element to retain and/or maintain structural support element 20 in the retracted position illustrated in FIGS. 3A-3B. It will be appreciated, however, that magnetic elements and/or electrical circuit components need not be connected to third connection element 34 and/or fourth connection element 42 in certain implementations.

As illustrated in FIG. 3B, structural support element 20 can also include a display surface 36. Display surface 36 can provide a wall lighting (e.g., sconce) effect or appearance. Accordingly, in the retracted position, structural support element 20 can comprise a wall lighting component that produces a (substantial) amount of light. In the extended position, structural support element 20 can comprise an embedded furniture support component and, optionally, a night-light that produces a low level or amount of light.

Figure 4A:
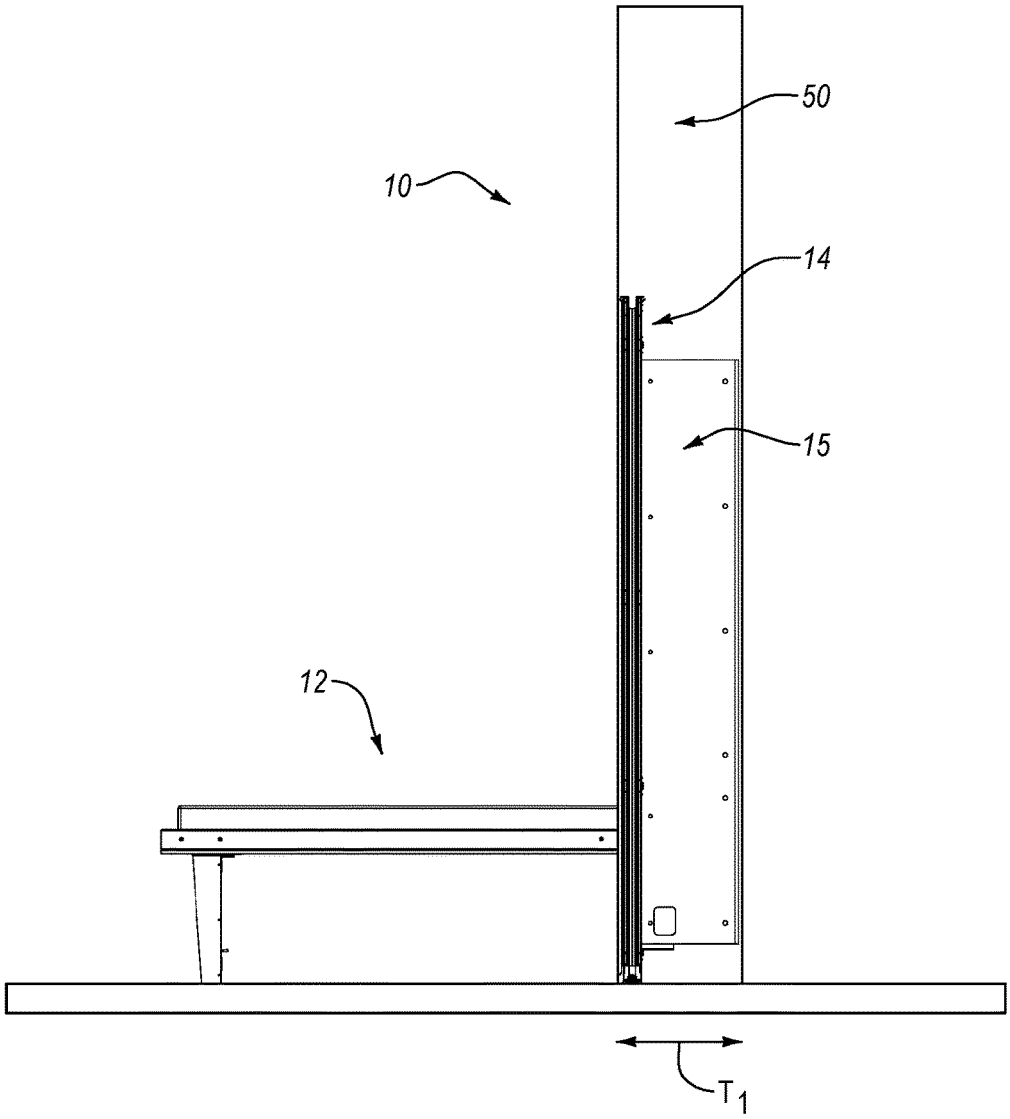
FIG. 4A illustrates a schematic view of the embedded furniture system of FIG. 1A in a wall environment.

Certain implementations of the present disclosure can conceal socket component 15. As depicted in FIG. 4A, for instance, socket component 15 can be concealed (entirely) within a wall 50. Specifically, wall 50 can be or comprise a full wall having a depth or thickness T1 (e.g., extending or sufficient to extend from the front (surface) 14*b* of furniture system 10 (or structural component 14 thereof) to the back (surface) of furniture system 10 (or socket component 15 thereof)). Accordingly, wall 50 may be (substantially or significantly) thicker than structural component 14 and/or industry standard (interior) walls (e.g., in order to receive socket component 15 (entirely) therein). Wall 50 can be, include, incorporate, or be incorporated into structural component 14, and vice versa.

Figure 4B:
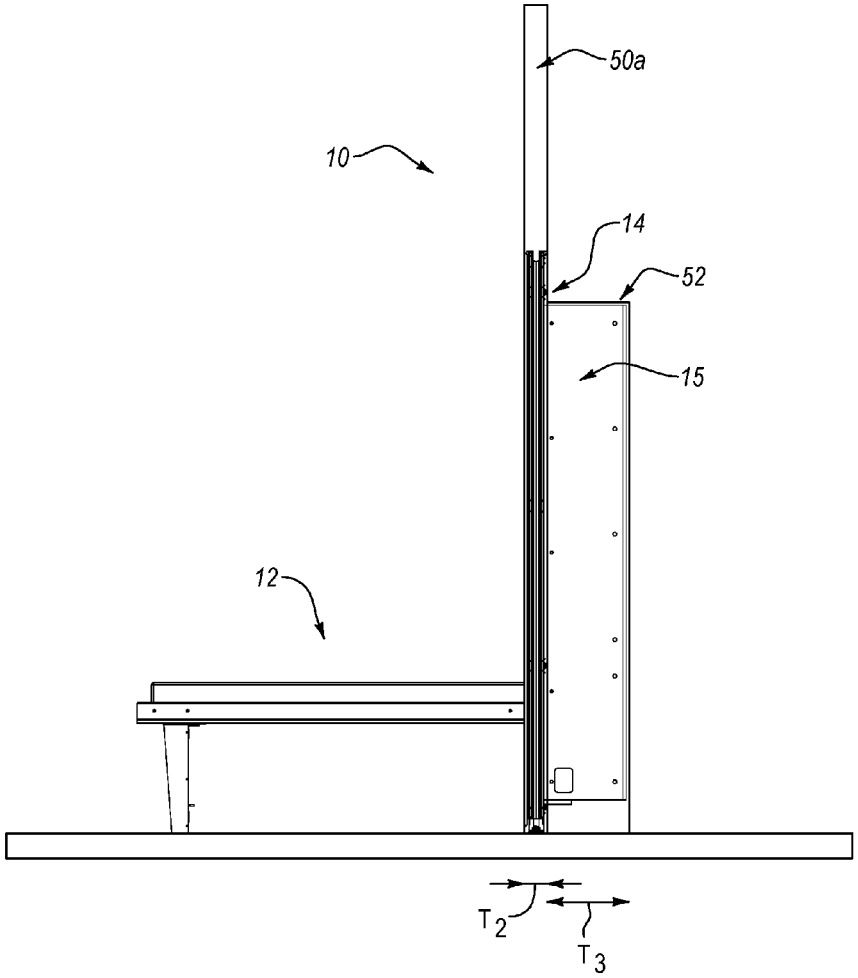
FIG. 4B illustrates a schematic view of the embedded furniture system of FIG. 1A in a modular wall display environment.

In alternative implementations, a feature, such as an aesthetic or (artificial) furniture component, can conceal (at least a (rear) portion of) socket component 15. As depicted in FIG. 4B and described in further detail below, for instance, socket component 15 can be substantially covered by or concealed by or within a concealing element 52.

As indicated above, structural component 14 can be or comprise a (modular) wall module or component. As depicted in FIG. 4B, structural component 14 can also (or alternatively) be installed or incorporated into and/or be disposed within a (modular) wall element 50*a*. Wall element 50*a* (and/or structural component 14) can have a thickness T2 (e.g., extending from the front (surface) of furniture system 10 (or structural component 14) to socket component 15 or the rear of structural component 14). Accordingly, thickness T2 can be substantially smaller than thickness T1 (see FIG. 4A), such that socket component 15 extends from the back side of wall element 50*a* (and/or structural component 14). Thus, structural component 14 can be disposed within wall element 50*a* and socket component 15 can be disposed within concealing element 52.

Concealing element 52 is provided to conceal the extending (portion of) socket component 15. Concealing element 52 can have a depth or thickness T3 sufficient to extend from the back side of wall element 50*a* to or past the back side of socket component 15. Thus, structural component 14 can be (or be disposed within) wall element 50*a* and socket component 15 can be disposed within concealing element 52.

Concealing element 52 can be or comprise any suitable covering sufficient to and/or capable of substantially covering or concealing socket component 15. For instance, concealing element 52 can be or comprise a furniture-shaped covering disposed about and substantially concealing the portion of socket component 15 that extends from wall element 50*a*. Concealing element 52 can comprise a false and/or substantially hollow piece of furniture or furniture component. For instance, concealing element 52 comprises a buffet-, armoire-, or other furniture-shaped covering with a hollow cavity therein for concealing socket component 15. Those skilled in the art will appreciate, however, that concealing element 52 can be or comprise any suitable covering sufficient to and/or capable of substantially concealing the portion of socket component 15 that extends from wall element 50*a*.

Concealing element 52 can be attached and/or connected to a rear side or surface of wall element 50*a* opposite a front display surface thereof. The front display surface can be substantially aligned with surface 13 of furniture element 12.

Figure 5A:
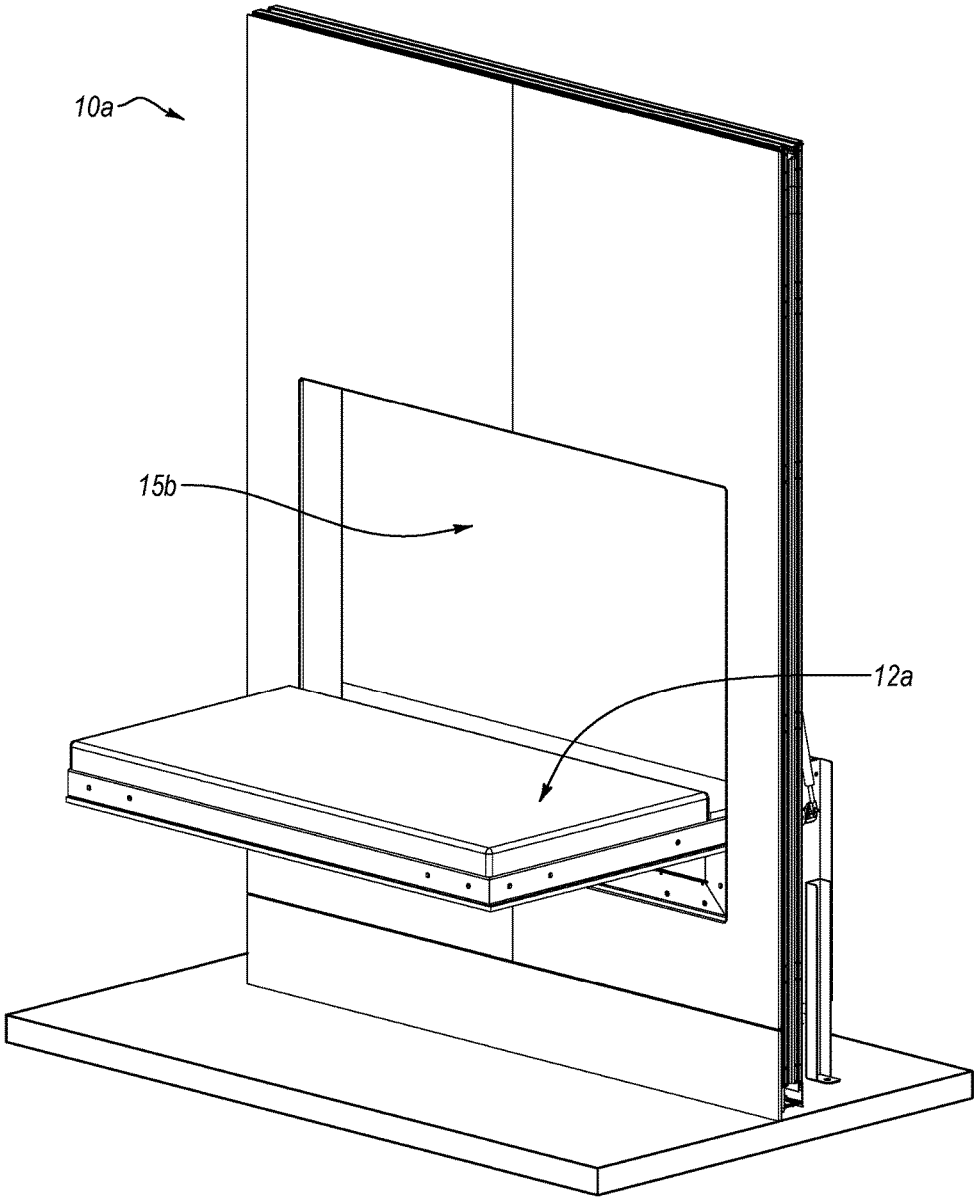
FIG. 5A illustrates a front perspective view of an embedded furniture system in a utility configuration according to another implementation of the present disclosure.
Figure 5B:
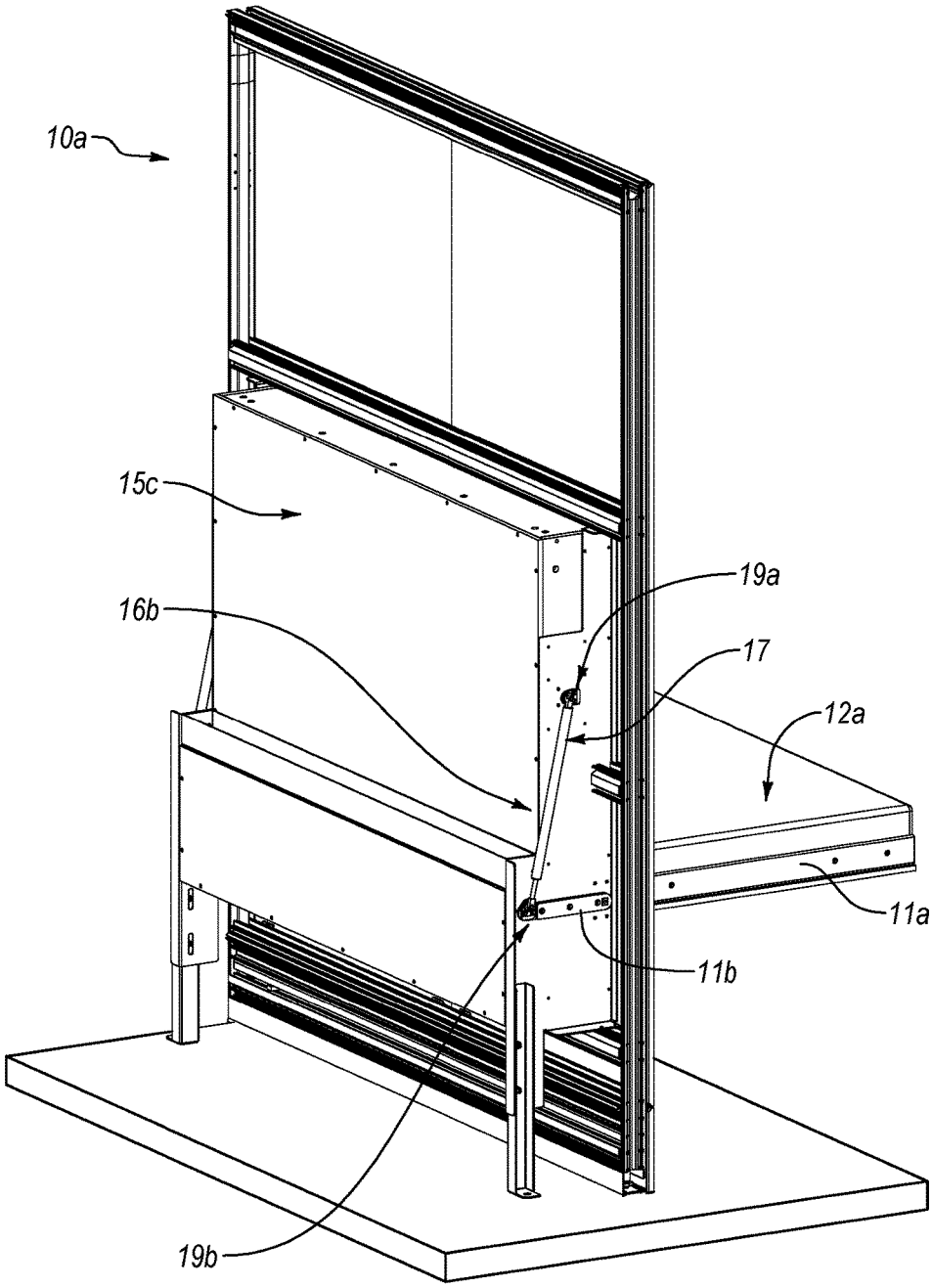
FIG. 5B illustrates a rear perspective view of the embedded furniture system of FIG. 5A.
Figure 5C:
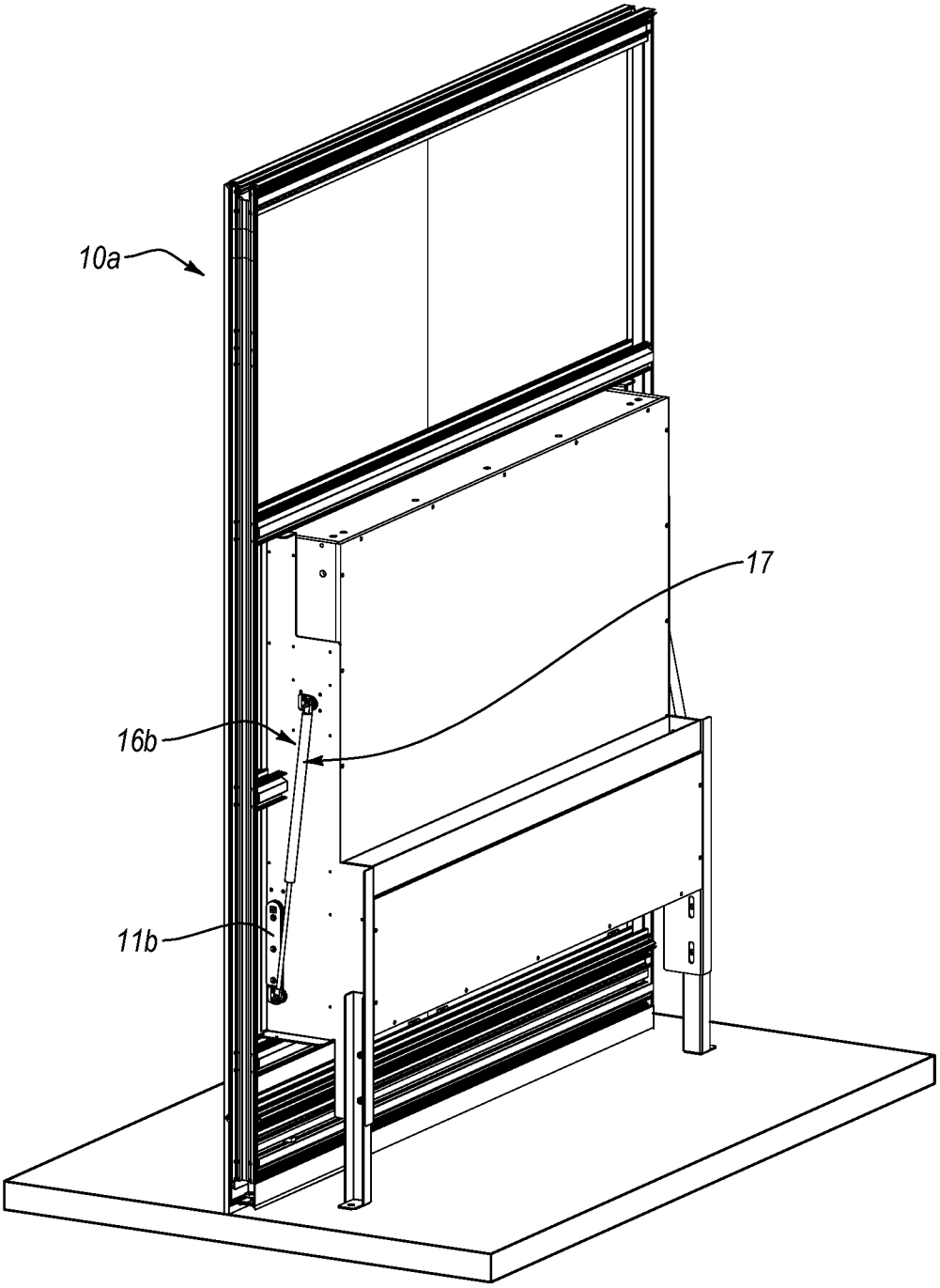
FIG. 5C illustrates a rear perspective view of the embedded furniture system of FIG. 5A in a storage configuration.

In at least one implementation, the furniture system can include a concealed actuating mechanism (or portion thereof). As depicted in FIGS. 5A-5C, for example, an embedded furniture system 10*a* can comprise a recessed compartment (or pocket) 15*b* and a furniture element 12*a* extending from pocket 15*b*. As depicted, furniture element 12*a* can comprise a workbench, shelf, table, desk, seat, etc. It is noted that a furniture actuating mechanism (or component thereof) is not visible within pocket 15*b*. As illustrated in FIG. 5B, furniture system 10*a* can include a (concealable) actuating mechanism 16*b*. Actuating mechanism 16*b* can comprise an piston element 17. Piston element 17 can comprise a (gas) piston or strut, as depicted, or a spring, pulley, gear, or other element, in other implementations.

Piston element 17 can be connected to a socket component 15*c* (or outer surface thereof) by means of a fastener 19*a*, such as an anchor, bracket, bolt, etc. Piston element 17 can also be connected to a connection component 11*b* by means of a fastener 19*b*. Connection component 11*b* can be attached to furniture element 12*a* (or a frame element 11*a* thereof). Moreover, in the utility position illustrated in FIGS. 5A and 5B, piston element 17 and connection component 11*b* can be disposed in a first (substantially horizontal and/or (spring) loaded) configuration (e.g., allowing furniture element 12*a* to extend from socket component 15*c* or compartment 15*b* thereof).

Fastener 19*a* and/or 19*b* can secure piston element 17 and, optionally, allow a degree of rotation. For instance, as depicted in FIG. 5C, furniture system 10*a* (or actuating mechanism 16*b* thereof) can be actuated into a storage position. In the depicted storage position, piston element 17 and connection component 11*b* can be disposed in a second (substantially vertical and/or unloaded) configuration (e.g., allowing furniture element 12*a* to be stowed within recessed pocket 15*b* of socket component 15*c*).

Figure 6:
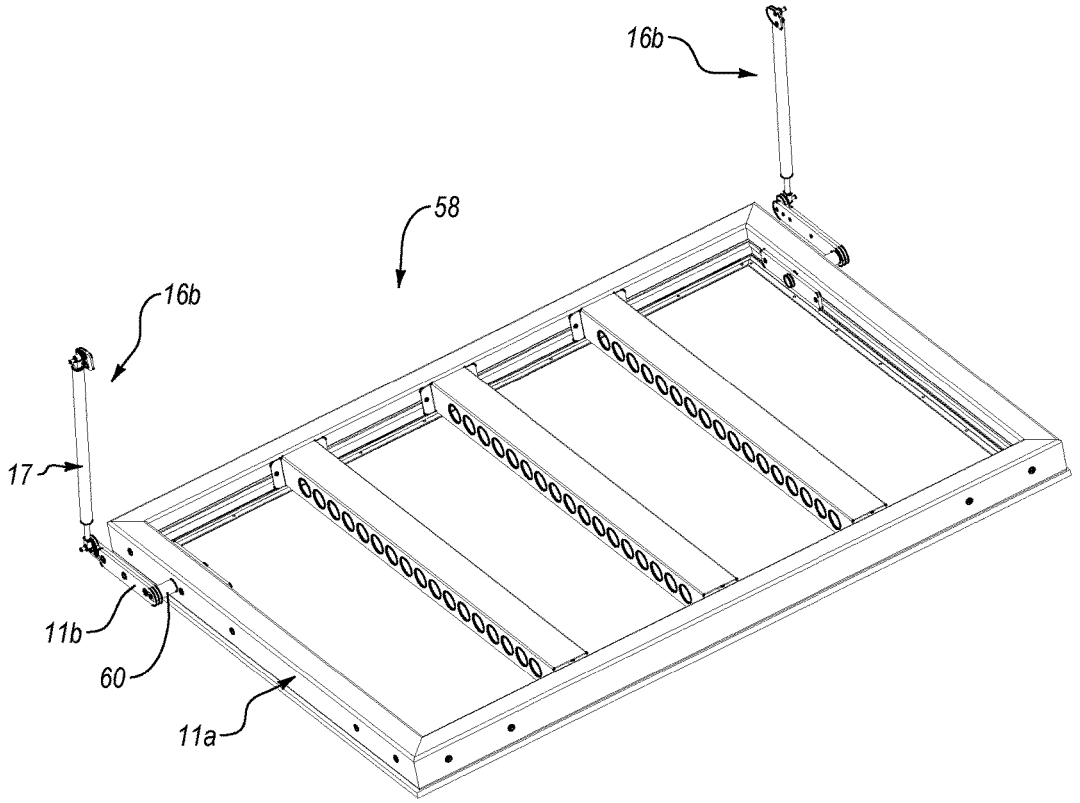
FIG. 6 illustrates a perspective view of a frame assembly according to an implementation of the present disclosure.
Figure 7:
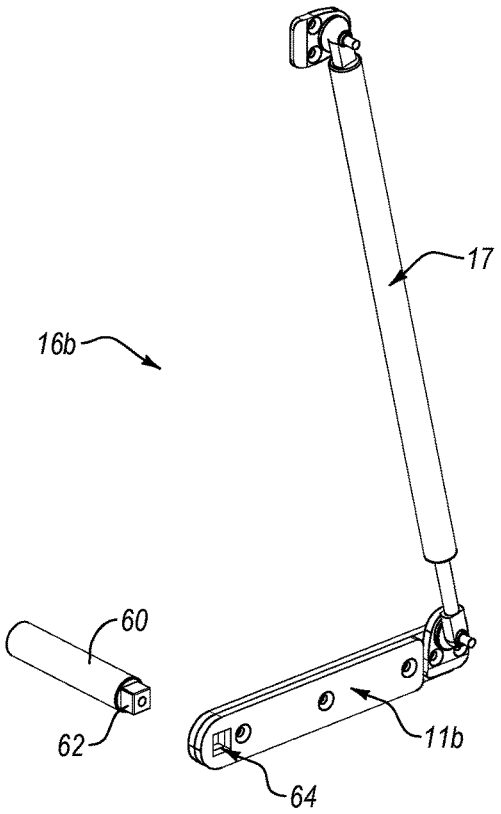
FIG. 7 illustrates a partial exploded view of a gas piston assembly according to an implementation of the present disclosure.

FIG. 6 illustrates a frame assembly 58 according to an implementation of the present disclosure. Frame assembly 58 can comprise furniture element frame component 11*a* (e.g., having an outer perimeter frame and, optionally, one or more inner frame elements), actuating mechanism 16*b* (e.g., including one or more (opposing) piston elements 17 and connection component 11*b*), and/or an attachment element 60 connecting frame component 11*a* to connection component 11*b*. attachment element 60 can have an attachment member 62 configured to interface with a connection member 64 of connection component 11*b* (such as with a socket (lock-and-key) fit). In at least one implementation, attachment member 62 can comprise a (unitary) piece of attachment element 60. For instance, attachment element 60 can be or comprise a machined (steel) hub rod in some implementations.

Attachment element 60 (or attachment member 62 thereof) and connection component 11*b* can be secured together by one or more fasteners (not shown). Attachment element 60 can also be secured to furniture element 12*a* (or frame component 11*a* thereof).

Figure 8:
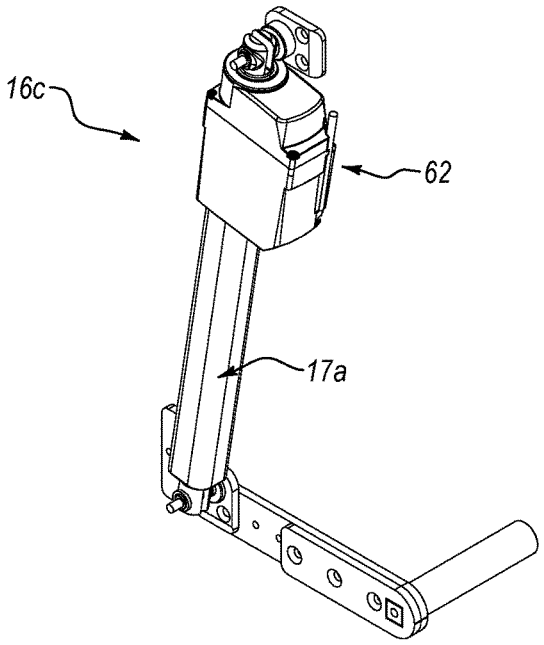
FIG. 8 illustrates a perspective view of an actuator assembly according to another implementation of the present disclosure.

FIG. 8 depicts an alternative actuating mechanism 16*c*. Actuating mechanism 16*c* comprises an actuating element 17*a*, comprising a piston or strut and an electric actuating element 62. Electric actuating element 62 can comprise a motor or other means for operating (or extending and/or retracting) actuating element 17*a*. Electric actuating element 62 can also be electrically coupled to a power source or supply, such as a battery or electric wire.

One will appreciate that implementations of the present disclosure can provide a wide variety of (modular) wall systems that provide a wide variety of benefits. For example, implementations of the present disclosure can provide a wall module having recessed, extendable furniture that is incorporated into the wall. In particular, certain implementations can include an embedded furniture system that includes a selectively extendable, retractable, and/or reconfigurable piece of furniture with a selectively extendable, retractable, and/or reconfigurable illuminating structural support element.

Various alterations and/or modifications of the inventive features illustrated herein, and additional applications of the principles illustrated herein, which would occur to one skilled in the relevant art and having possession of this disclosure, can be made to the illustrated implementations without departing from the spirit and scope of the invention as defined by the claims, and are to be considered within the scope of this disclosure. Thus, while various aspects and implementations have been disclosed herein, other aspects and implementations are contemplated. While a number of methods and components similar or equivalent to those described herein can be used to practice implementations of the present disclosure, only certain components and methods are described herein.

It will also be appreciated that systems, processes, and/or products according to certain implementations of the present disclosure may include, incorporate, or otherwise comprise properties or features (e.g., components, members, elements, parts, and/or portions) described in other implementations disclosed and/or described herein. For instance, various features (e.g., actuating mechanisms 16*a*, 16*b*, 16*c*, wall (element) 50, 50*a*, etc.) described herein in relation to one implementation can be (interchangeably) substituted in other implementations of the present disclosure. Accordingly, the various features of certain implementations can be compatible with, combined with, included in, and/or incorporated into other implementations of the present disclosure. Thus, disclosure of certain features relative to a specific implementation of the present disclosure should not be construed as limiting application or inclusion of said features to the specific implementation. Rather, it will be appreciated that other implementations can also include said features without necessarily departing from the scope of the present disclosure.

Moreover, unless a feature is described as requiring another feature in combination therewith, any feature herein may be combined with any other feature of a same or different implementation disclosed herein. Furthermore, various well-known aspects of illustrative systems, processes, products, and the like are not described herein in particular detail in order to avoid obscuring aspects of the example implementations. Such aspects are, however, also contemplated herein.

The present disclosure may be embodied in other specific forms without departing from its spirit or essential characteristics. The described implementations are to be considered in all respects only as illustrative and not restrictive. The scope of the invention is, therefore, indicated by the appended claims rather than by the foregoing description. Each of the appended claims, as well as the recited elements thereof, is intended to be combinable with any other claim(s) and/or element(s) in any suitable combination or dependency without regard to the dependency in which said claims are presented. While certain implementations and details have been included herein and in the attached disclosure for purposes of illustrating implementations of the present disclosure, it will be apparent to those skilled in the art that various changes in the methods and apparatus disclosed herein may be made without departing from the scope of the invention, which is defined in the appended claims. All changes which come within the meaning and range of equivalency of the claims are to be embraced within their scope.

We claim:

1. An embedded furniture system, comprising:

a furniture element;

a support element connected to the furniture element and selectively positionable between a retracted position and an extended position, the support element having a lighting element configured to illuminate when the support element is in the retracted position;

an illuminating mechanism comprising a first contact element connected to the furniture element and a second contact element connected to the support element;

wherein in the retracted position, the second contact element contacts the first contact element to complete an electrical circuit configured to illuminate the lighting element.

2. The embedded furniture system of claim 1, wherein:

the support element is hingedly connected to a surface of the furniture element and selectively hingedly positionable relative to the surface; and, in the retracted position, the support element extends along the surface and in the extended position, the support element extends from the surface.

3. The embedded furniture system of claim 1, wherein:

the furniture element is connected to a structural component and selectively moveable between a storage position and a utility position, the structural component comprises a socket component having a stowage pocket recessed therein;

in the storage position, the furniture element is disposed at least partially within the stowage pocket; and in the utility position, the furniture element extends from the structural component.

4. The embedded furniture system of claim 3, wherein in the utility position, the furniture element is supported above a floor by the support element disposed in the extended position.

5. The embedded furniture system of claim 3, further comprising:

an actuating mechanism connected between the furniture element and the structural component;

wherein:

the actuating mechanism directs the furniture element between the utility position into the storage position; and the actuating mechanism provides a mechanical advantage for moving the furniture element from the utility position into the storage position.

6. The embedded furniture system of claim 5, wherein the actuating mechanism comprises an electric actuating member configured to selectively move the furniture element between the utility position and the storage position.

7. The embedded furniture system of claim 5, wherein:

the actuating mechanism comprises a piston or strut connected to the furniture element and the structural component;

the structural component comprises a socket component having an inner surface defining the stowage pocket and an outer surface disposed opposite the stowage pocket; and the piston or strut is disposed at and connected to the outer surface.

8. The embedded furniture system of claim 3, wherein:

the structural component further comprises a modular wall element attached to the socket component;

the modular wall element and the furniture element each comprise a display surface, the support element is connected to the display surface of the furniture element; and in the storage position, the display surface of the furniture element is substantially aligned with the display surface of the modular wall element.

9. The embedded furniture system of claim 8, wherein the structural component comprises a socket component having an inner surface defining the stowage pocket and an outer surface disposed opposite the stowage pocket, the system further comprising:

a display element disposed about the outer surface opposite the display surface of the modular wall element.

10. The embedded furniture system of claim 1, further comprising a power source electrically coupled to the lighting element.

11. The embedded furniture system of claim 10, wherein the power source comprises a battery or electric wiring.

12. An embedded furniture system, comprising:

a structural component comprising a socket component having a furniture stowage pocket recessed therein;

a furniture element hingedly connected to the structural component such that the furniture element is selectively moveable between (i) a storage position in which the furniture element is substantially disposed within the stowage pocket and (ii) a utility position in which the furniture element extends from the stowage pocket in a generally horizontal orientation, the furniture element having an outer wall surface that is at least partially exposed when the furniture element is in a storage position;

one or more retractable support elements hingedly connected to the outer wall surface of the furniture element and selectively positionable between (i) an extended position in which a longitudinal length of the one or more support elements protrude substantially perpendicular to the outer wall surface and (ii) a retracted position in which the longitudinal length of the one or more support elements extend substantially parallel to the outer wall surface, the one or more support elements having a lighting element disposed therein; and an illuminating mechanism configured to illuminate the lighting element when the one or more support elements are in the retracted position, the illuminating mechanism comprising:

a first contact element connected to the outer wall surface of the furniture element; and a second contact element connected to the one or more support element, wherein in the retracted position, the second contact element communicates with the first contact element to complete an electrical circuit configured to illuminate the lighting element.

13. The embedded furniture system of claim 12, wherein in the utility position, the furniture element is supported above a floor by the one or more support elements disposed in the extended position.

14. The embedded furniture system of claim 13, further comprising:

an actuating mechanism connected between the furniture element and the structural component;

wherein:

the actuating mechanism directs the furniture element between the utility position into the storage position; and the actuating mechanism provides a mechanical advantage for moving the furniture element from the utility position into the storage position.

15. The embedded furniture system of claim 14, wherein the actuating mechanism comprises an electric actuating member configured to selectively move the furniture element between the utility position and the storage position.

16. The embedded furniture system of claim 14, wherein:

the actuating mechanism comprises a piston or strut connected to the furniture element and the structural component;

the structural component comprises a socket component having an inner surface defining the stowage pocket and an outer surface disposed opposite the stowage pocket; and the piston or strut is disposed at and connected to the outer surface.

17. The embedded furniture system of claim 14, wherein:

the structural component further comprises a modular wall element attached to the socket component;

the modular wall element and the furniture element each comprise a display surface, the support element is connected to the display surface of the furniture element; and in the storage position, the display surface of the furniture element is substantially aligned with the display surface of the modular wall element.

18. The embedded furniture system of claim 17, wherein the structural component comprises a socket component having an inner surface defining the stowage pocket and an outer surface disposed opposite the stowage pocket, the system further comprising:

a display element disposed about the outer surface opposite the display surface of the modular wall element.

19. The embedded furniture system of claim 12, further comprising a power source electrically coupled to the lighting element.

20. A method of stowing extendable furniture, comprising:

actuating a furniture element from a utility position into a storage position, the furniture element being in a generally horizontal orientation in the utility position and a generally vertical orientation in the storage position; and actuating a support element from an extended position into a retracted position, wherein:

the support element comprises a lighting element connected thereto; and actuating the support element into the retracted position illuminates the lighting element;

the structural component has a first circuit element disposed on the contact surface;

the furniture element has a second circuit element disposed on the outer wall surface; and actuating the support element comprises bringing the first circuit element into contact with the second circuit element, thereby completing an electrical circuit configured to illuminate the lighting element.

21. The method of claim 20, wherein actuating the structural component into the retracted position completes an electrical circuit configured to illuminate the lighting element.

22. The method of claim 20, wherein:

the support element is hingedly connected to an outer wall surface of the furniture element;

actuating the support element comprises hingedly pivoting the support element from the extended position into the retracted position;

in the extended position, a contact surface of the support element extends longitudinally from the outer wall surface; and in the retracted position, the contact surface of the support element extends along the outer wall surface.

23. The method of claim 20, wherein:

actuating the furniture element comprises engaging an actuating mechanism connected between a structural component and the furniture element; and the actuating mechanism provides a mechanical advantage for moving the furniture element from the utility position into the storage position.

24. The method of claim 23, wherein:

the actuating mechanism comprises an electric actuating member configured to selectively move the furniture element between the utility position and the storage position; and actuating the furniture element comprises selectively engaging the electric actuating member.

25. The method of claim 23, wherein:

the structural component comprises a socket component having a stowage pocket recessed therein; and actuating the furniture element comprises positioning the furniture element substantially within the stowage pocket.

* * * * *